US011179938B2

(12) United States Patent
Fujita

(10) Patent No.: US 11,179,938 B2
(45) Date of Patent: Nov. 23, 2021

(54) LIQUID DISCHARGE HEAD, HEAD MODULE, HEAD DEVICE, LIQUID DISCHARGE DEVICE, AND LIQUID DISCHARGE APPARATUS

(71) Applicant: Ricoh Company, Ltd., Tokyo (JP)

(72) Inventor: Akihiro Fujita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/848,907

(22) Filed: Apr. 15, 2020

(65) Prior Publication Data

US 2020/0384767 A1 Dec. 10, 2020

(30) Foreign Application Priority Data

Jun. 10, 2019 (JP) ..... JP2019-108185

(51) Int. Cl.
*B41J 2/14* (2006.01)
*B41J 2/16* (2006.01)

(52) U.S. Cl.
CPC ..... *B41J 2/1433* (2013.01)

(58) Field of Classification Search
CPC ..... B41J 2/1623; B41J 2/1433
See application file for complete search history.

(56) References Cited

U.S. PATENT DOCUMENTS

2004/0246291 A1 12/2004 Kinpara
2018/0037028 A1* 2/2018 Kobayashi ..... B41J 2/1433

FOREIGN PATENT DOCUMENTS

JP 2001-162802 6/2001
JP 2003-276192 9/2003
WO WO2016/133117 A1 8/2016

* cited by examiner

*Primary Examiner* — Jason S Uhlenhake
(74) *Attorney, Agent, or Firm* — Xsensus LLP

(57) ABSTRACT

A liquid discharge head includes a first member in which a plurality of channels is arrayed in a longitudinal direction of the first member, a second member bonded to the first member with adhesive, and three or more holes formed in a bonding region between the first member and the second member. An inner volume of each of the three or more holes is different, an area of each of the three or more holes is different, the three or more holes includes a hole having a smallest inner volume among the three or more holes, and the hole is filled with the adhesive in the bonding region.

17 Claims, 18 Drawing Sheets

LIQUID DISCHARGE HEAD, HEAD MODULE, HEAD DEVICE, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-108185, filed on Jun. 10, 2019, in the Japan Patent Office, the entire disclosures of which is hereby incorporated by reference herein.

BACKGROUND

Technical Field

Aspects of the present disclosure relate to a liquid discharge head, a liquid discharge device, and a liquid discharge apparatus.

Related Art

An aspect of the present disclosure relates to a liquid discharge head, a head module, a head device, a liquid discharge device, and a liquid discharge apparatus.

A liquid discharge head to discharge a liquid includes an adhesive escape hole including a concave portion, a groove portion, and the like. The adhesive escape hole prevents an adhesive to enter a channel formed by bonding a first member in which the channel is formed to a second member as another member with the adhesive.

For example, two types of adhesive escape holes are arranged in a radial direction around the channel. The adhesive escape holes have different sizes (areas).

SUMMARY

In an aspect of this disclosure, a liquid discharge head includes a first member in which a plurality of channels is arrayed in a longitudinal direction of the first member, a second member bonded to the first member with adhesive, and three or more holes formed in a bonding region between the first member and the second member. An inner volume of each of the three or more holes is different, an area of each of the three or more holes is different, the three or more holes include a hole having a smallest inner volume among the three or more holes, and the hole is filled with the adhesive in the bonding region.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
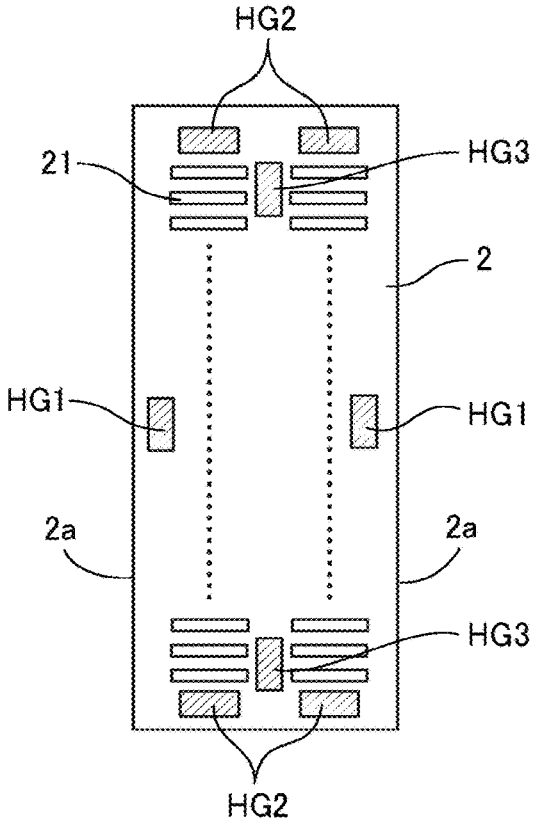
FIG. 1 is a schematic plan view of a first member according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Embodiments of the present disclosure are described below with reference to the attached drawings. Next, a first embodiment of the present disclosure is described with reference to FIGS. 1 and 2.

Figure 2:
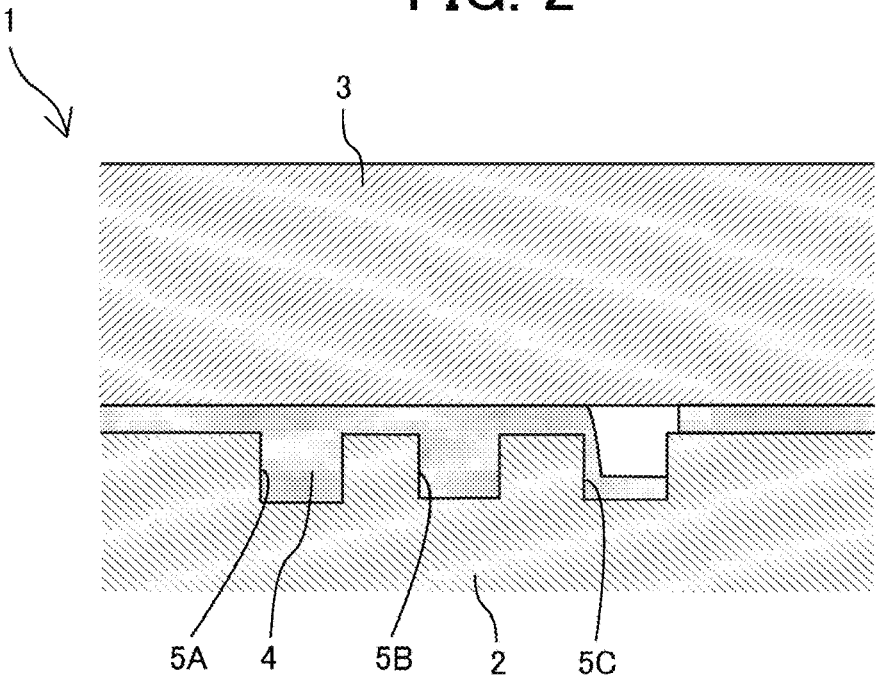
FIG. 2 is a schematic cross-sectional view of the first member and a second member bonded to the first member.
Figure 3A:
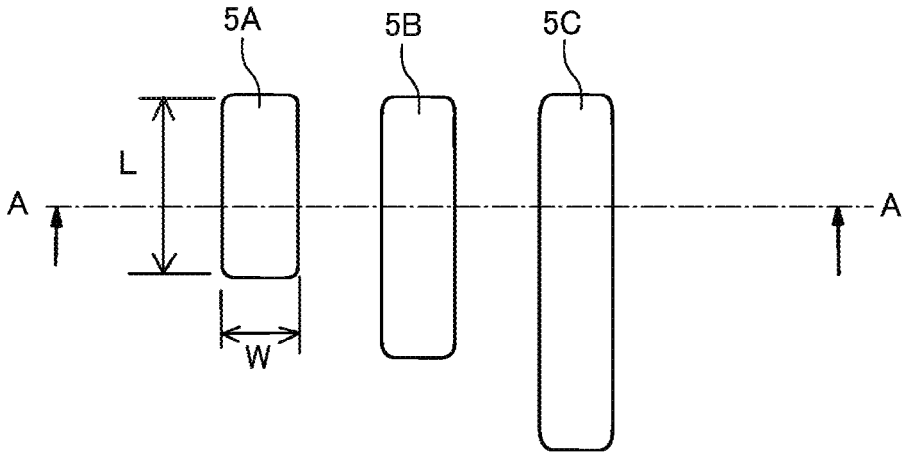
FIGS. 3A and 3B are schematic plan views of holes of the first member.
Figure 3B:
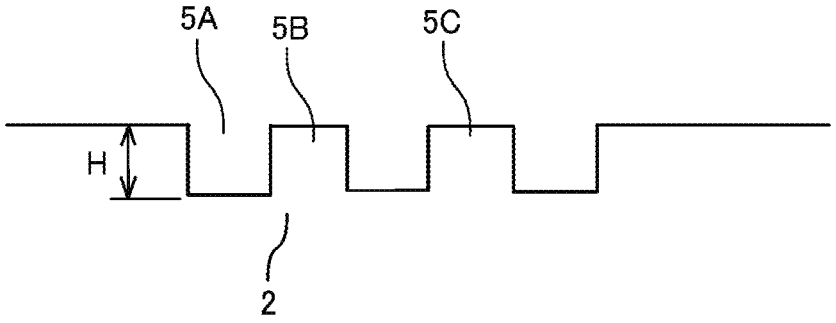

FIG. 1 is a schematic plan view of a first member according to a first embodiment of the present disclosure. FIG. 2 is a schematic cross-sectional view of the first member and a second member bonded to the first member. FIGS. 3A and 3B are schematic plan views of holes of the first member. FIGS. 4A, 5A, 6A and 7A are schematic plan views of the holes 5A to 5C. FIG. 3B is a cross-sectional view of the holes of the first member along a line A-A in FIG. 3A.

A liquid discharge head 1 includes a channel member 2 that is a first member in which a pressure chamber 21 as a channel is formed. Hereinafter, the liquid discharge head 1 is simply referred to as the "head 1." A second member 3 as another member is bonded to the channel member 2 with an adhesive 4. The second member 3 includes, for example, a nozzle plate in which nozzles are formed, a holding substrate (protective substrate) in which the channel to supply liquid to the pressure chamber 21 is formed, a common-channel member or a frame member in which a common channel is formed, and the like.

The channel member 2 includes three or more holes 5 (5A, 5B, and 5C) having different inner volumes (volumes) and different areas in an in-plane direction of the channel member 2 in a bonding region between the channel member 2 (first member) and the second member 3.

As illustrated in FIGS. 3A and 3B, three holes 5A to 5C are arrayed in parallel at a predetermined interval in a longitudinal direction of the channel member 2 (first member). A direction of array of three holes 5A to 5C (lateral direction in FIG. 3A) is referred to as an "array direction." The holes 5A to 5C have different lengths "L" in a direction perpendicular to the array direction of the holes 5A to 5C (vertical direction in FIG. 3A). Further, a width "W" of each of the holes 5A to 5C in the array direction are identical, and a depth "H" of each of the holes 5A to 5C are identical.

That is, an area of the hole 5A is the minimum. Areas of the holes 5A to 5C (three or more holes) gradually increase in an order of the holes 5A, 5B, and 5C. A size of the hole 5A is determined as a "small size," a size of the hole 5B is determined as a "medium size," and a size of the hole 5C is determined as a "large size" The lengths L, widths W, and depths H of the holes 5A to 5C are set in a range of 2 μm to 20 μm.

As illustrated in FIG. 1 according to the present embodiment, the hole patterns HG1 are arranged between each edge 2*a* of the channel member 2 and one of arrays of channels (pressure chambers 21) closest to one of the edges 2*a* of the channel member 2. In FIG. 1, there are two arrays of channels (pressure chambers 21) arranged in parallel in a width direction perpendicular to the longitudinal direction of the channel member 2. Further, each of two arrays of channels (pressure chambers 21) are arrayed in the longitudinal direction of the channel member 2. The hole patterns HG1 are one the hole patterns HG (HG1 to HG3) that are configured by the plurality of holes 5 (5A to 5C) in the present embodiment. The longitudinal direction of each of the hole patterns HG1 is parallel with the longitudinal direction of channel member 2.

The hole patterns HG2 are respectively arranged outside the arrays of the channels (pressure chambers 21) in a longitudinal direction of the channel member 2. In FIG. 1, two hole patterns HG2 are respectively arranged outside the two arrays of the channels (pressure chambers 21). The longitudinal direction of each of the hole patterns HG2 is in the width direction perpendicular to the longitudinal direction of channel member 2.

The hole patterns HG3 are arranged between the two arrays of the channels (pressure chambers 21). The hole patterns HG3 are serially arranged in the longitudinal direction of the channel member 2 such that a longitudinal direction of each of the hole patterns HG3 is parallel with the longitudinal direction of the channel member 2.

Thus, the array direction of the holes 5A to 5C in each of the hole patterns HG1 and HG3 is parallel with the longitudinal direction (vertical direction in FIG. 1) of the channel member 2 (first member). Conversely, the array direction of the holes 5A to 5C in each of the hole patterns HG2 is parallel with the width direction (lateral direction in FIG. 1) perpendicular to the longitudinal direction of the channel member 2 (first member).

Next, an effect of the present embodiment is described with reference to FIGS. 4A and 4B to FIGS. 7A to 7B. FIGS. 4A and 4B to FIGS. 7A to 7B are schematic views illustrate the effect of the present embodiment. FIGS. 4A, 5A, 6A and 7A are schematic plan views of the holes 5A to 5C. FIGS. 4B, 5B, 6B and 7B are schematic cross-sectional views of the holes 5A to 5C. Note that, in each of FIGS. 5B, 6B, and 7B, a cross-sectional line of the channel member 2 is omitted.

When the channel member 2 and the second member 3 are bonded with the adhesive 4, the adhesive 4 is applied by, for example, a printing method such as flexographic printing or screen printing, or spray coating. A coating thickness (film thickness) of the adhesive 4 is set to be about submicron to about 5 μm.

In the present embodiment, the hole patterns HG including the holes 5A, 5B, and 5C form a determination pattern to determine an amount of the adhesive 4 to be applied (application amount). Here, as illustrated in FIGS. 4A and 4B or FIGS. 5A and 5B, it is determined that the application amount of the adhesive 4 is appropriate when a small hole 5A is fully filled with the adhesive 4 (full state), and a large hole 5C is partially filled (not fully filled) with the adhesive 4 (non-full state).

Figure 6A:
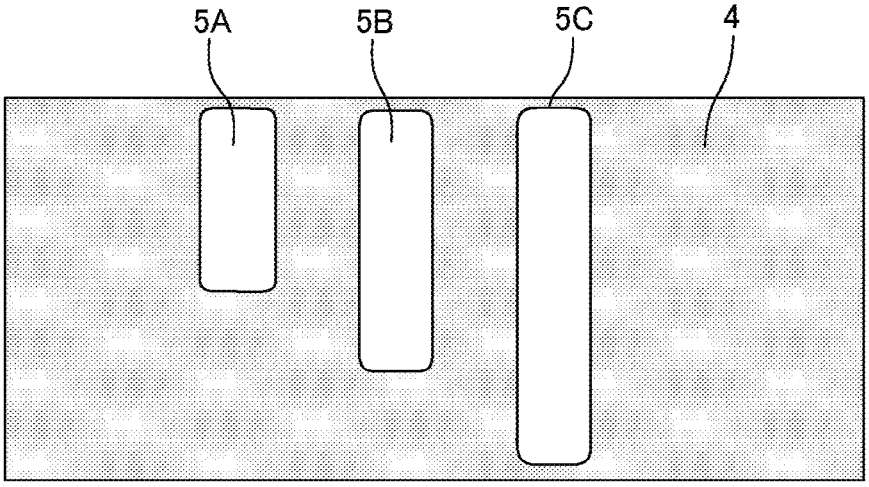
FIGS. 6A and 6B are schematic plan views of operation of the holes in the first embodiment.
Figure 6B:
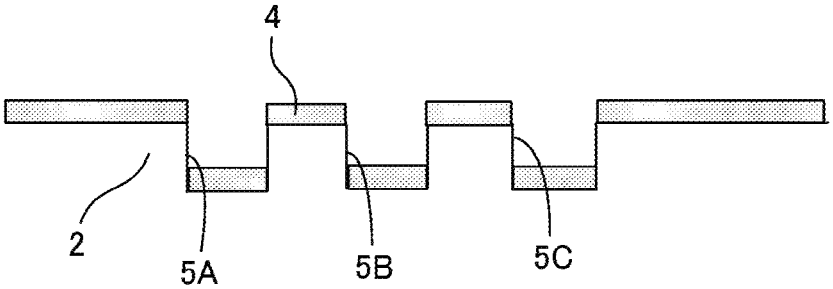
Figure 7A:
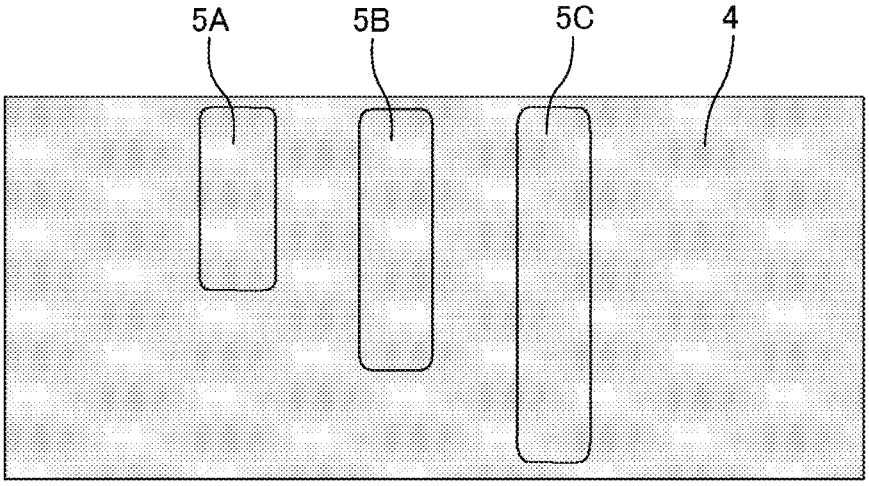
FIGS. 7A and 7B are schematic plan views of operation of the holes in the first embodiment.
Figure 7B:
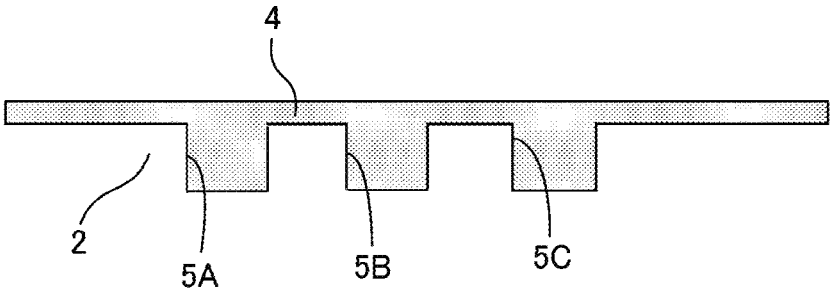

Conversely, as illustrated in FIGS. 6A and 6B, it is determined that the application amount of adhesive 4 is insufficient when a small hole 5A is not fully filled with the adhesive 4 (non-full state). Thus, it is determined that a bonding state with the adhesive 4 between the channel member 2 and the second member 3 is in an inappropriate state. Further, as illustrated in FIGS. 7A and 7B, it is determined that the application amount of the adhesive 4 is excessive when the large hole 5C is fully filled with the adhesive 4 (full state). Thus, it is determined that a bonding state with the adhesive 4 between the channel member 2 and the second member 3 is in an inappropriate state.

Further, a medium hole 5B is not used to determine whether the adhesive bonding is appropriate or inappropriate. The medium hole 5B is used to further inspect the application amount of the adhesive 4 in detail.

Figure 4A:
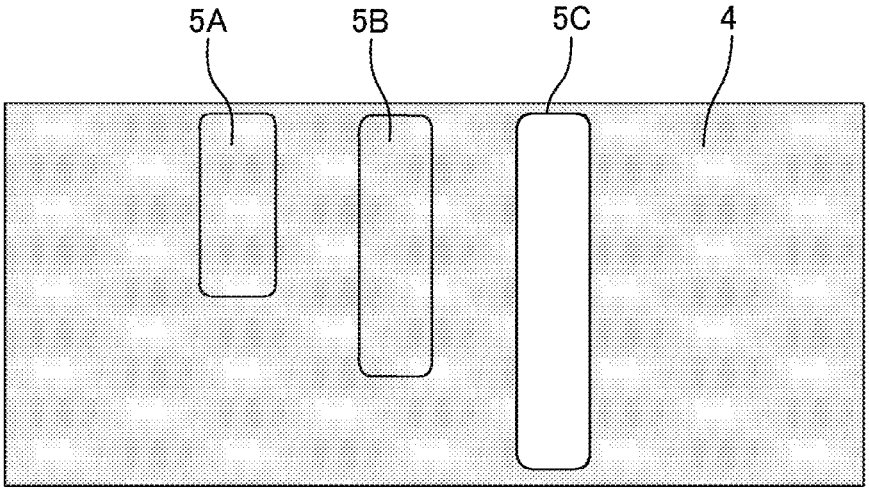
FIGS. 4A and 4B are schematic plan views of operation of the holes in the first embodiment.
Figure 4B:
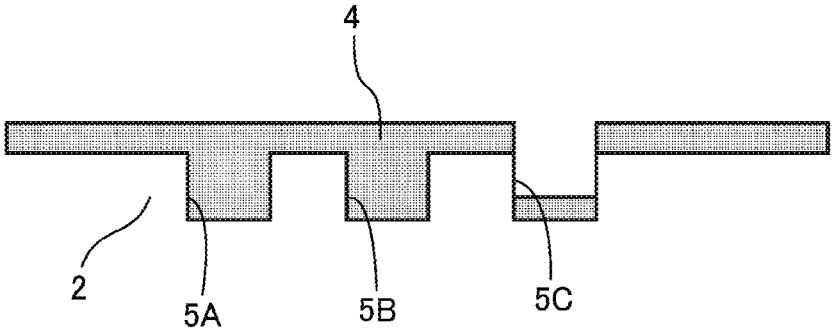
Figure 5A:
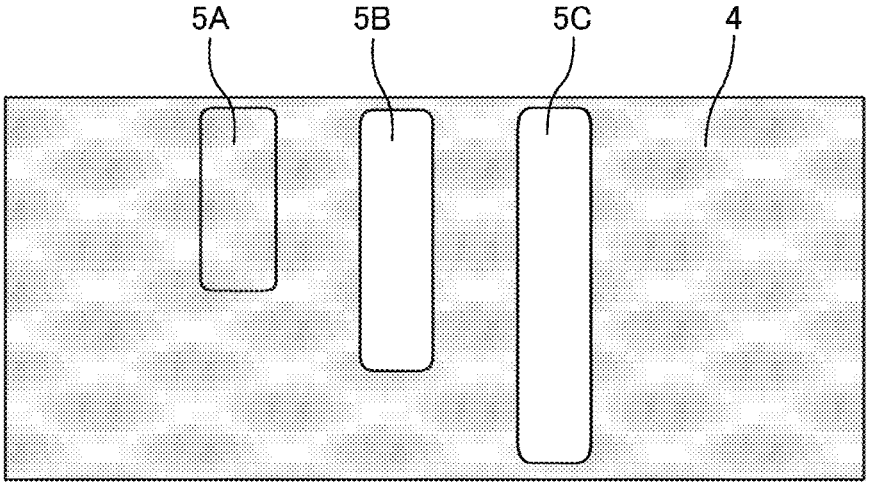
FIGS. 5A and 5B are schematic plan views of operation of the holes in the first embodiment.
Figure 5B:
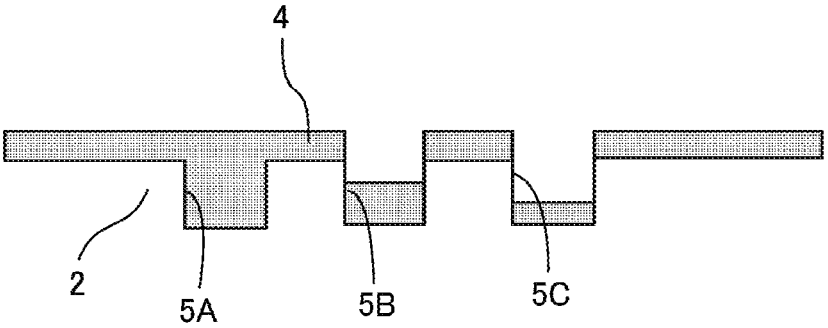

For example, completed heads 1 are classified into ranks after the application amount of the adhesive 4 is determined to be appropriate for the small hole 5A (full state) and the large hole 5C (non-full state). For example, a state in which the medium hole 5B is fully filled with the adhesive 4 (full state) as illustrated in FIGS. 4A and 4B is ranked as rank 1, and a state in which the medium hole 5B is partially filled (not fully filled) with the adhesive 4 (non-full state) as illustrated in FIGS. 5A and 5B is ranked as rank 2.

Thus, the head 1 includes a first member (channel member 2) including a plurality of channels (pressure chambers 21) arrayed in a longitudinal direction of the first member (channel member 2), a second member 3 bonded to the first member with adhesive 4, and a three or more holes 5A to 5C formed in a bonding region between the first member (channel member 2) and the second member 3. An inner volume of each of the three or more holes 5A to 5C is different. An area of each of the three or more holes 5A to 5C is different. The three or more holes 5A to 5C include a small hole 5A having a smallest inner volume among the three or more holes 5A to 5C, and at least the small hole 5A is fully filled with the adhesive 4 in the bonding region of the head 1.

Further, the three or more holes 5A to 5C include another hole (large hole 5C) having an inner volume larger than the smallest inner volume of the hole (small hole 5A) among the three or more holes, and the another hole (large hole 5C) is partially filled with the adhesive 4 in the bonding region.

Further, the three or more holes 5A to 5C include a large hole 5C having a largest inner volume among the three or more holes 5A to 5C, and a medium hole 5B having a medium inner volume between the smallest inner volume and the largest inner volume among the three or more holes 5A to 5C. The medium hole 5B is fully filled with the adhesive 4 in the bonding region, and the largest hole 5C is partially filled with the adhesive 4 in the bonding region.

A difference in discharge characteristics such as difference in a droplet speed or a droplet volume occurs when an actuator element (for example, a piezoelectric element) is driven with identical drive voltage since a rigidity of the pressure chamber 21 differs according to the application amount of the adhesive 4, that is, the bonding state of the channel member 2 and the second member 3 with the adhesive 4.

Thus, an appropriate drive voltage for a drive waveform corresponding to each of the ranked heads 1 is previously set to homogenize the discharge characteristics of the heads 1 in a head module in which the heads 1 are modularized.

In the above-described way, it is possible to determine the application amount of the adhesive 4 in detail.

Figure 8A:
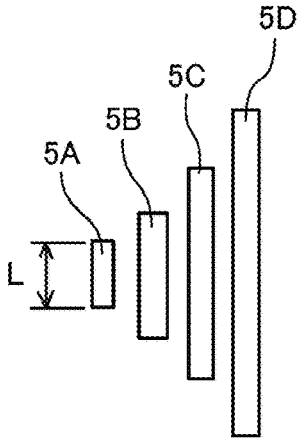
FIGS. 8A to 8C are schematic plan views.
Figure 8B:
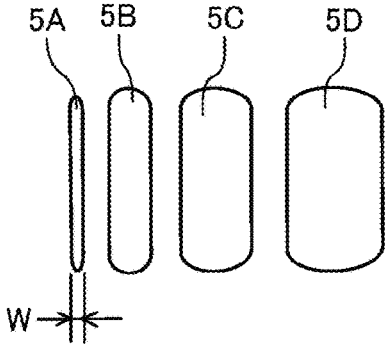
Figure 8C:
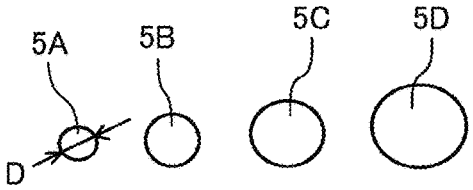
Figure 8D:
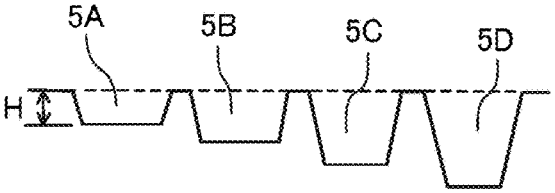
FIG. 8D is a schematic cross-sectional view of first to fourth examples of hole patterns having different shapes according to the first embodiment of the present disclosure.

Next, a first example to a fourth example having different hole patterns HG is described below with reference to FIGS. 8A to 8D. FIGS. 8A to 8D illustrate different examples of the hole patterns HG. FIGS. 8A to 8C are schematic plan views of the hole pattern including holes 5A to 5D. FIG. 8D is a schematic cross-sectional view of the hole patterns HG including the holes 5A to 5D.

The hole pattern HG in the first example as illustrated in FIG. 8A includes four long groove-shaped holes 5 (5A to 5D). Lengths L of the holes 5A to 5D in a longitudinal direction (vertical direction in FIG. 8A) perpendicular to the array direction (lateral direction in FIG. 8A) of the holes 5A to 5D are different. A shape of each of the holes 5A to 5D of the hole pattern HG in the first example is a rectangular. The hole pattern HG in the second example as illustrated in FIG. 8B includes four groove-shaped holes 5 (5A to 5D). The lengths L of the holes 5A to 5D in the longitudinal direction (vertical direction in FIG. 8B) are identical, and widths "W" of the holes 5A to 5D in the array direction (lateral direction in FIG. 8B) are different. A shape of each of the holes 5A to 5D of the hole pattern HG in the second example is an oval.

The hole pattern HG in the third example as illustrated in FIG. 8C includes four circular holes 5 (5A to 5D). Diameters "D" of the holes 5A to 5D are different. A shape of each of the holes 5A to 5D of the hole pattern HG in the third example is a circle. The hole pattern HG in the fourth example as illustrated in FIG. 8D includes four circular holes 5 (5A to 5D). Heights (depths) "H" of the holes 5A to 5D are different. A shape of each of the holes 5A to 5D of the hole pattern HG in the fourth example is a circle as in the third example in FIG. 8C.

Figure 9:
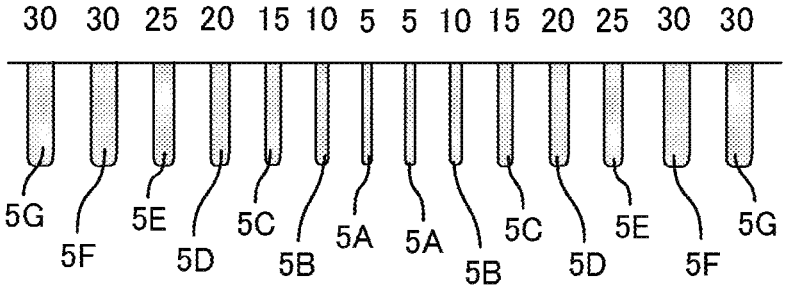
FIG. 9 is a schematic plan view of a fifth example of the hole pattern HG according to the first embodiment of the present disclosure.

Next, a fifth example of the hole pattern HG is described with reference to FIG. 9. FIG. 9 is a schematic plan view of the fifth example of the hole pattern HG.

In the fifth example, areas of the holes 5A to 5G gradually increase from a small hole 5A disposed in a center in the array direction (lateral direction in FIG. 9) toward a large hole 5G disposed at both ends in the array direction of the channel member 2. Numbers indicated in upper part in FIG. 9 are examples of widths W of the holes 5A to 5G. In FIG. 9, the width "W" is changed from 5 μm (holes 5A) to 30 μm (holes 5G).

Thus, at least six (eight in the fifth example) holes 5A to 5G are arrayed side by side in the array direction (lateral direction in FIG. 9), and the areas of the holes 5A to 5G gradually increase or increase stepwise from the holes 5A in the center toward the holes 5G at both ends of the channel member 2. In FIG. 9, the holes 5A to 5G are arrayed side by side in the longitudinal direction of the channel member 2 (first member).

Thus, the hole pattern HG includes at least six holes 5A to 5G arrayed side by side in the array direction (lateral direction in FIG. 9), and areas of the at least six holes 5A to 5G gradually increase or increase stepwise from the holes 5A in a center toward the holes 5G at both ends of the hole pattern HG in the array direction.

Figure 10:
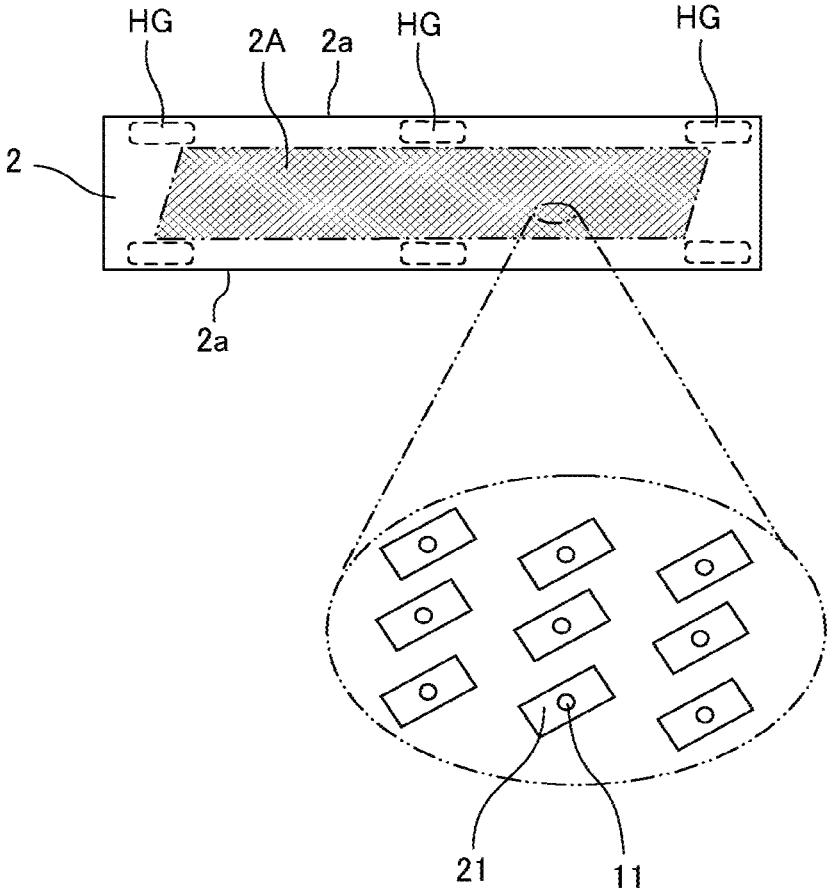
FIG. 10 is a schematic plan view and an enlarged schematic plan view of the channel member as a first member in a second embodiment of the present disclosure.

A second embodiment according to the present disclosure is described with reference to FIG. 10. FIG. 10 is a schematic plan view and an enlarged schematic plan view of the channel member 2 as a first member in the second embodiment.

The channel member 2 includes an arrangement region 2A of the pressure chambers 21 in which nozzles 11 and the pressure chambers 21 are arranged in a two-dimensional matrix. The nozzles 11 respectively communicate with the pressure chambers 21.

The channel member 2 includes the hole patterns HG in a center and both ends of the channel member 2 in a longitudinal direction (lateral direction in FIG. 10) of channel member 2. The hole patterns HG are arranged between the arrangement region 2A (array) of the pressure chambers 21 and each edge 2*a* of channel member 2 in a width direction (vertical direction in FIG. 10) perpendicular to the longitudinal direction of channel member 2. The hole patterns HG as described in one of the first to fifth examples (see FIGS. 8A to 8D and FIG. 9) in the first embodiment may be applied to the hole pattern HG in the second embodiment.

Figure 12:
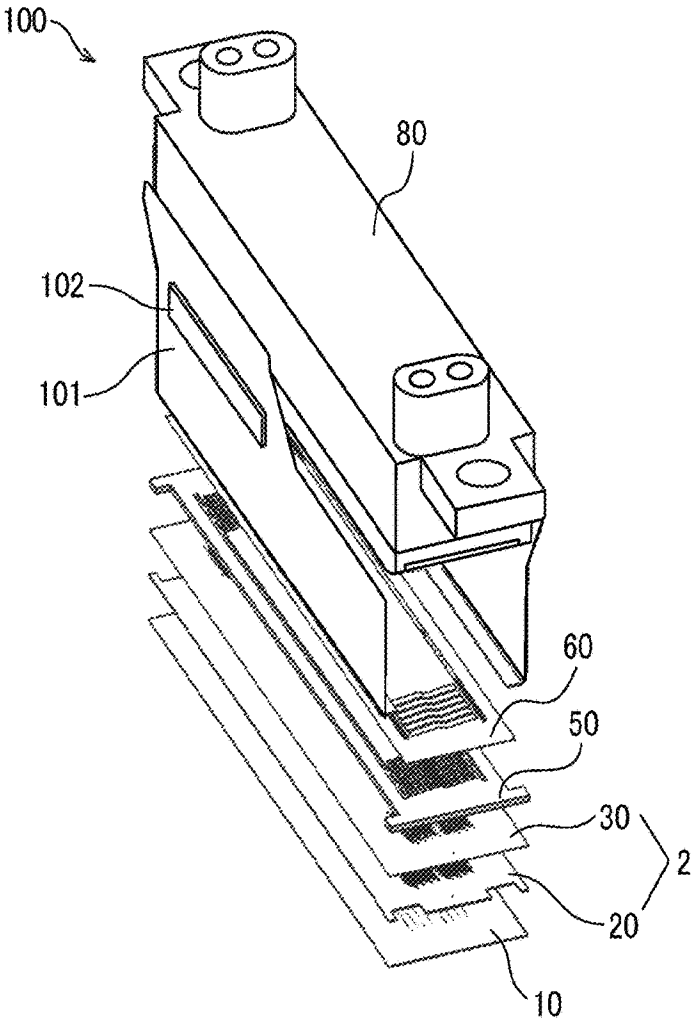
FIG. 12 is an exploded perspective view of the liquid discharge head according to the second embodiment of the present disclosure.
Figure 11:
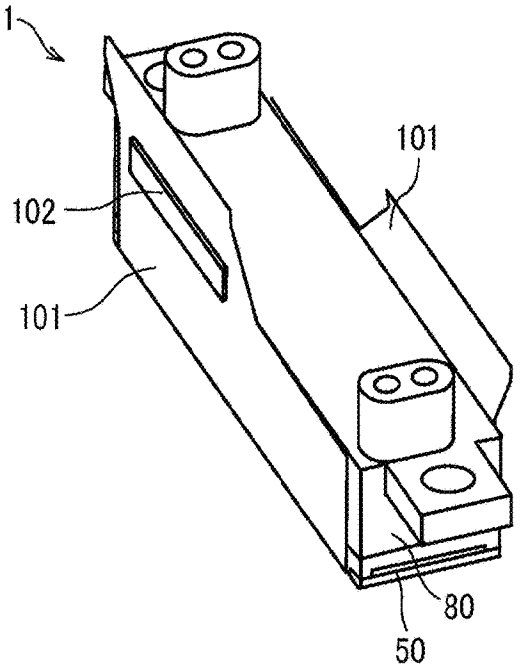
FIG. 11 is an outer perspective view of a liquid discharge head according to the second embodiment of the present disclosure.
Figure 13:
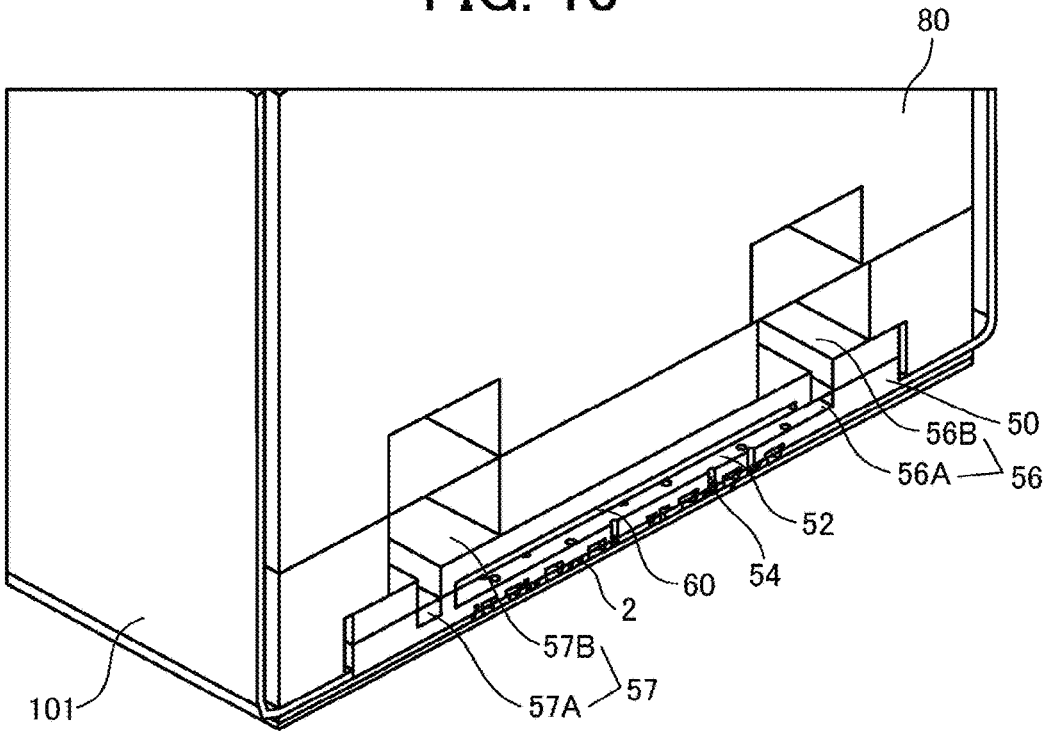
FIG. 13 is a schematic cross-sectional perspective view of the liquid discharge head in the second embodiment of the present disclosure.
Figure 14:
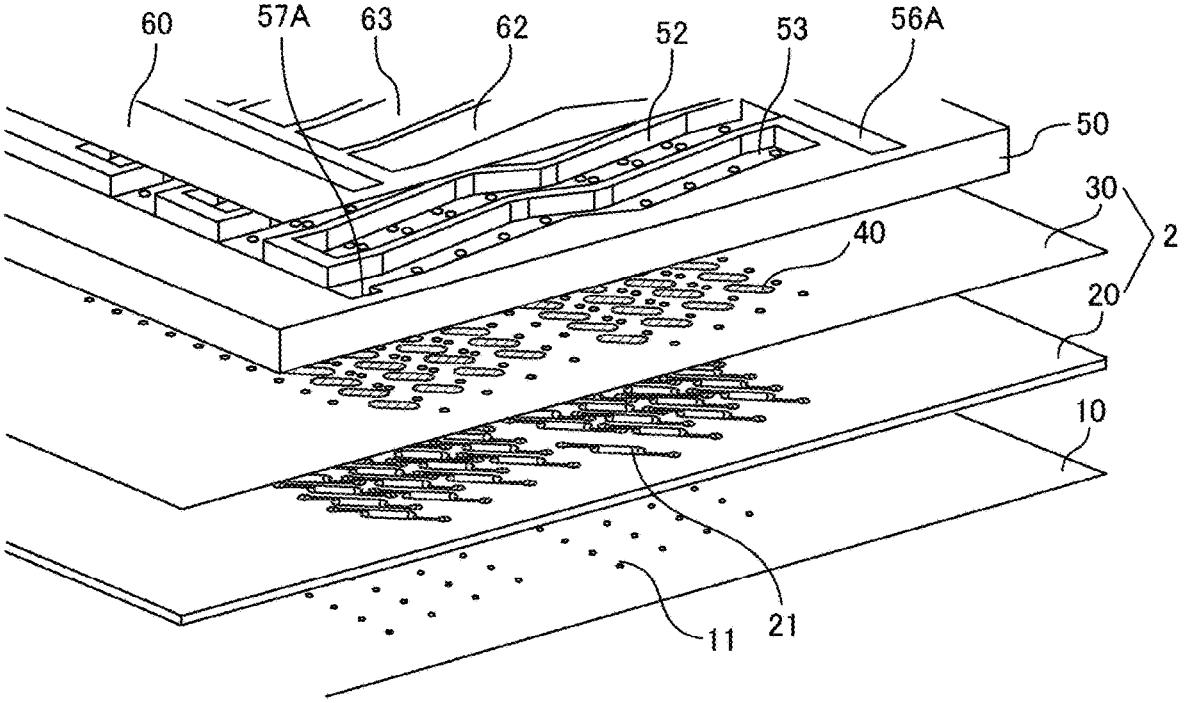
FIG. 14 is an exploded perspective view of the liquid discharge head without a frame in the second embodiment.
Figure 15:
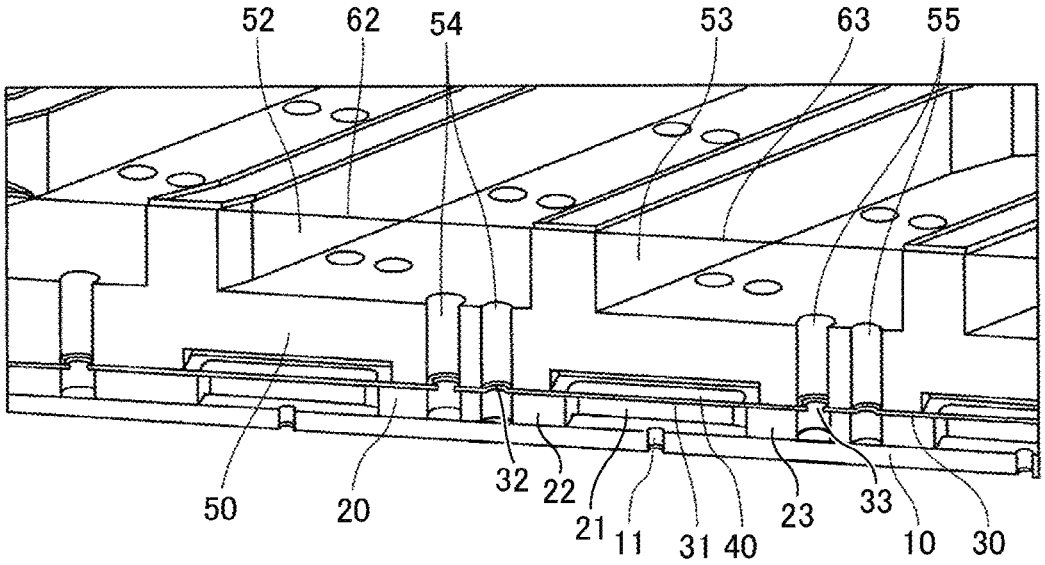
FIG. 15 is an enlarged cross-sectional perspective view of the channels in the second embodiment.

Next, the head 1 according to the second embodiment as described above is described with reference to FIGS. 11 to 16. FIG. 11 is a schematic perspective view of exterior of the head 1. FIG. 12 is an exploded perspective view of the head 1. FIG. 13 is a cross-sectional perspective view of the head 1. FIG. 14 is an exploded perspective view of the head 1 without a frame 80. FIG. 15 is an enlarged cross-sectional perspective view of the channels in the second embodiment.

Figure 16:
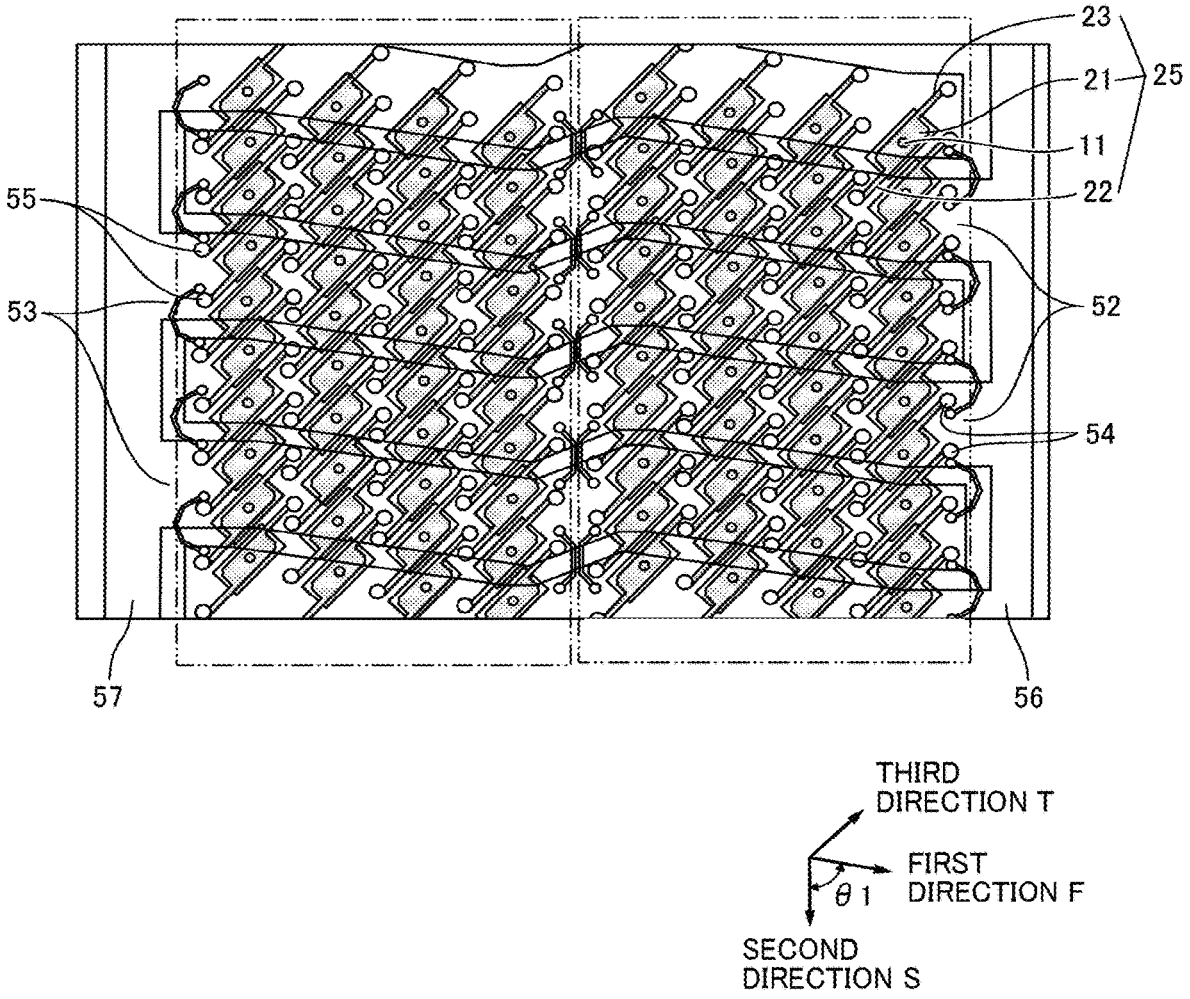
FIG. 16 is a plan view of the channels of the liquid discharge head in the second embodiment.

FIG. 16 is a plan view of the channels of the liquid discharge head in the second embodiment;

As illustrated in FIG. 12, the head 1 includes a nozzle plate 10, an individual-channel member 20 (channel plate), a diaphragm member 30, a common-channel member 50, a damper 60, a frame 80, and a flexible wiring 101 (substrate) mounting a drive circuit 102. The flexible wiring 101 is also referred to as a flexible wiring substrate.

The nozzle plate 10 includes a plurality of nozzles 11 to discharge a liquid (see FIG. 14). The plurality of nozzles 11 are arranged in a two-dimensional matrix. Thus, the nozzle plate 10 includes the plurality of nozzles 11 to discharge a liquid. As illustrated in FIG. 16, the plurality of nozzles 11 are arranged two-dimensionally in a matrix and are arranged side by side in three directions of a first direction F, a second direction S, and a third direction T.

The individual-channel member 20 includes a plurality of pressure chambers 21 (individual chambers) respectively communicating with the plurality of nozzles 11, a plurality of individual-supply channels 22 respectively communicating with the plurality of pressure chambers 21, and a plurality of individual-collection channels 23 respectively communicating with the plurality of pressure chambers 21 (see FIG. 14). A combination of one pressure chamber 21, one individual-supply channel 22 communicating with one pressure chamber 21, and one individual-collection channel 23 communicating with one pressure chamber 21 is collectively referred to as an individual chamber 25.

The diaphragm member 30 forms a diaphragm 31 serving as a deformable wall of the pressure chamber 21, and the piezoelectric element 40 is formed on the diaphragm 31 to form a single body. Further, the diaphragm member 30 includes a supply opening 32 communicating with the individual-supply channel 22 and a collection opening 33 communicating with the individual-collection channel 23. The piezoelectric element 40 is a pressure generator to deform the diaphragm 31 to pressurize the liquid in the pressure chamber 21.

Note that the individual-channel member 20 and the diaphragm member 30 are not limited to be separate members. For example, an identical member such as a Silicon on Insulator (SOI) substrate may be used to form the individual-channel member 20 and the diaphragm member 30 in a single body. That is, an SOI substrate formed by sequentially forming a silicon oxide film, a silicon layer, and a silicon oxide film on a silicon substrate is used. The silicon substrate in the SOI substrate forms the individual-channel member 20, and the silicon oxide film, the silicon layer, and the silicon oxide film in the SOI substrate form the diaphragm 31. In the above-described configuration, the layer structure of the silicon oxide film, the silicon layer, and the silicon oxide film in the SOI substrate forms the diaphragm member 30. As described above, the diaphragm member 30 includes a member made of the material that is film-formed on a surface of the individual-channel member 20.

In the present embodiment, the channel member 2 includes the individual-channel member 20 and the diaphragm member 30 formed with the same member as single body.

The common-channel member 50 includes a plurality of common-supply branch channels 52 that communicate with two or more individual-supply channels 22 and a plurality of common-collection branch channels 53 that communicate with two or more individual-collection channels 23 as illustrated in FIG. 14. The plurality of common-supply branch channels 52 and the plurality of common-collection branch channels 53 are arranged alternately adjacent to each other in the second direction S of the nozzles 11.

As illustrated in FIG. 14, the common-channel member 50 includes a through hole serving as a supply port 54 that connects the supply opening 32 of the individual-supply channel 22 and the common-supply branch channel 52, and a through hole serving as a collection port 55 that connects the collection opening 33 of the individual-collection channel 23 and the common-collection branch channel 53.

The common-channel member 50 includes one or more common-supply main channels 56 (see FIG. 13) that communicate with the plurality of common-supply branch channels 52, and one or more common-collection main channels 57 (see FIGS. 13 and 14) that communicate with the plurality of common-collection branch channels 53. A portion 56A is one of portions of the common-supply main channels 56, and a portion 57A is one of portions of the common-collection main channels 57.

As illustrated in FIG. 15, the damper 60 includes a supply-side damper 62 that faces (opposes) the supply port 54 of the common-supply branch channel 52 and a collection-side damper 63 that faces (opposes) the collection port 55 of the common-collection branch channel 53.

As illustrated in FIGS. 15 and 16, the supply-side damper 62 and the collection-side damper 63 of the damper 60 seal grooves in the common-channel member 50 to form the common-supply branch channel 52 and the common-collection branch channel 53. The grooves are alternately arranged in the common-channel member 50 in a longitudinal direction of the common-supply main channel 56. Both common-supply branch channel 52 and the common-collection branch channel 53 are formed in the same common-channel member 50. The grooves are alternately arranged in the common-channel member 50 to form the common-supply branch channel 52 and the common-collection branch channel 53.

The frame 80 forms a remaining portion 56B of the common-supply main channels 56 and a remaining portion 57B of the common-collection main channels 57.

The common-channel member 50 is also referred to as a "holder (protector)." When the common-channel member 50 is referred to as the holder, the frame 80 is also referred to as a "common channel member."

Here, the hole patterns HG is formed in an arrangement region illustrated in FIG. 10 in a bonding region between the channel member 2 and the common-channel member 50. The hole pattern HG includes three or more holes 5.

Figure 18:
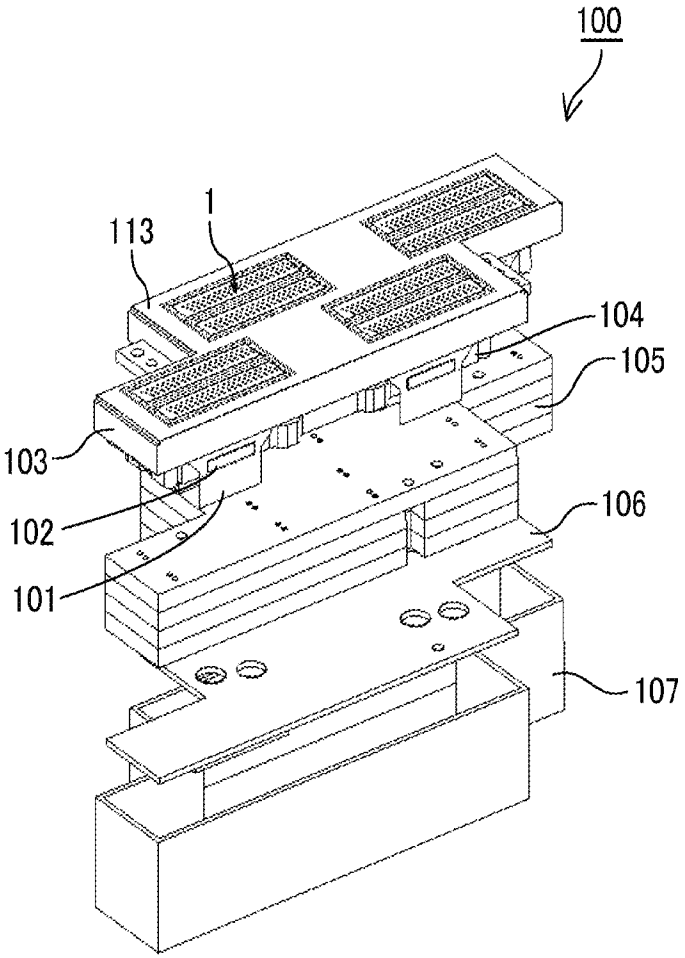
FIG. 18 is an exploded perspective view of the head module viewed from a nozzle surface side of the head module of FIG. 17.
Figure 17:
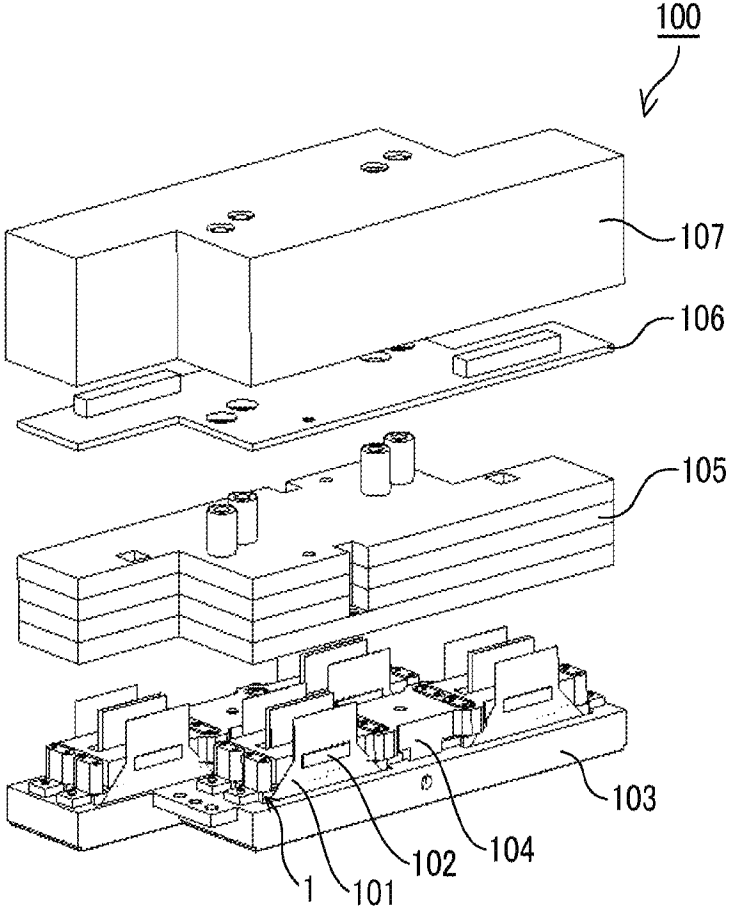
FIG. 17 is an exploded perspective view of a head module according to an embodiment of the present disclosure.

FIGS. 17 and 18 illustrate an example of a head module according to an embodiment of the present disclosure. FIG. 17 is an exploded perspective view of the head module 100. FIG. 18 is an exploded perspective view of the head module 100 viewed from a nozzle surface side of the head module 100.

The head module 100 includes a plurality of heads 1 as described above, a base 103 that holds the plurality of heads 1, and a cover 113 that serves as a nozzle cover of the plurality of heads 1.

Further, the head module 100 includes a heat radiator 104, a manifold 105 forming a channel to supply liquid to the plurality of heads 1, a printed circuit board 106 (PCB) connected to the flexible wiring 101 (substrate), and a module case 107.

Figure 19:
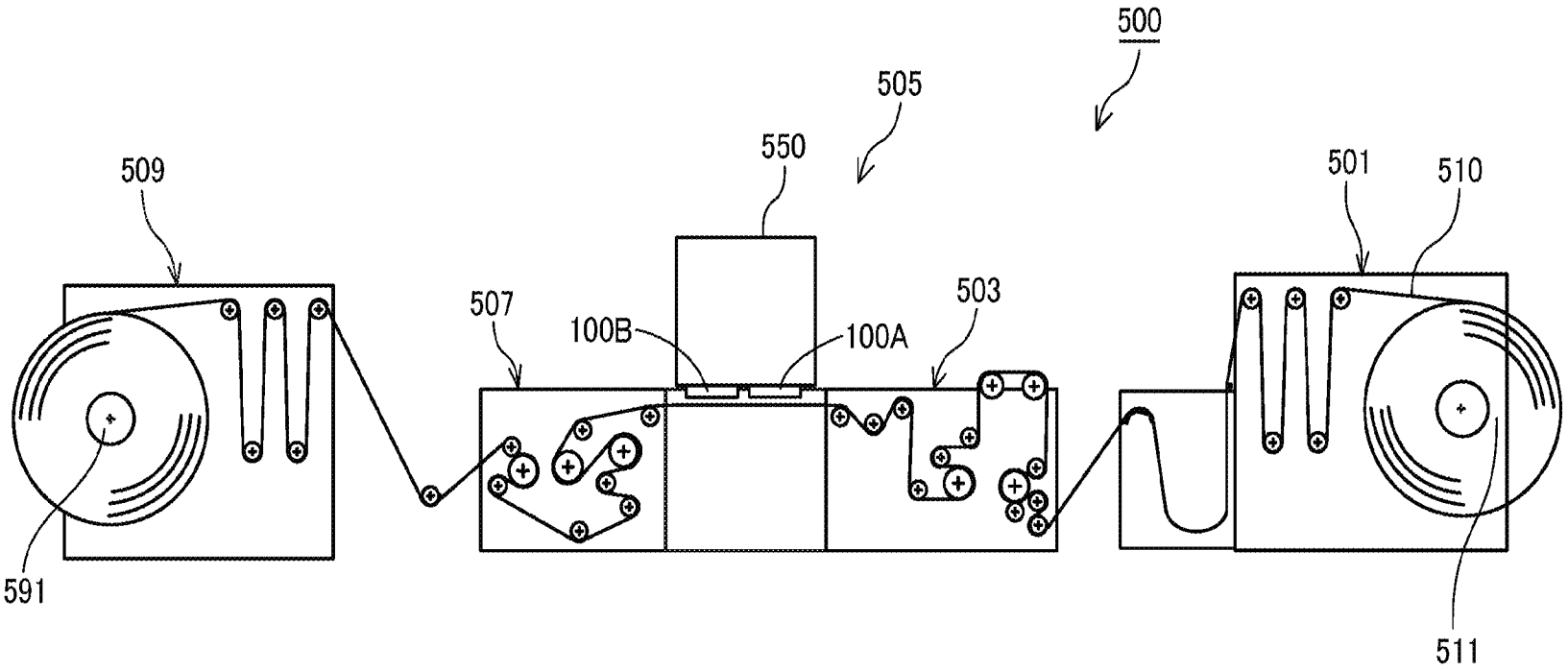
FIG. 19 is a schematic side view of a liquid discharge apparatus according to an embodiment of the present disclosure.
Figure 20:
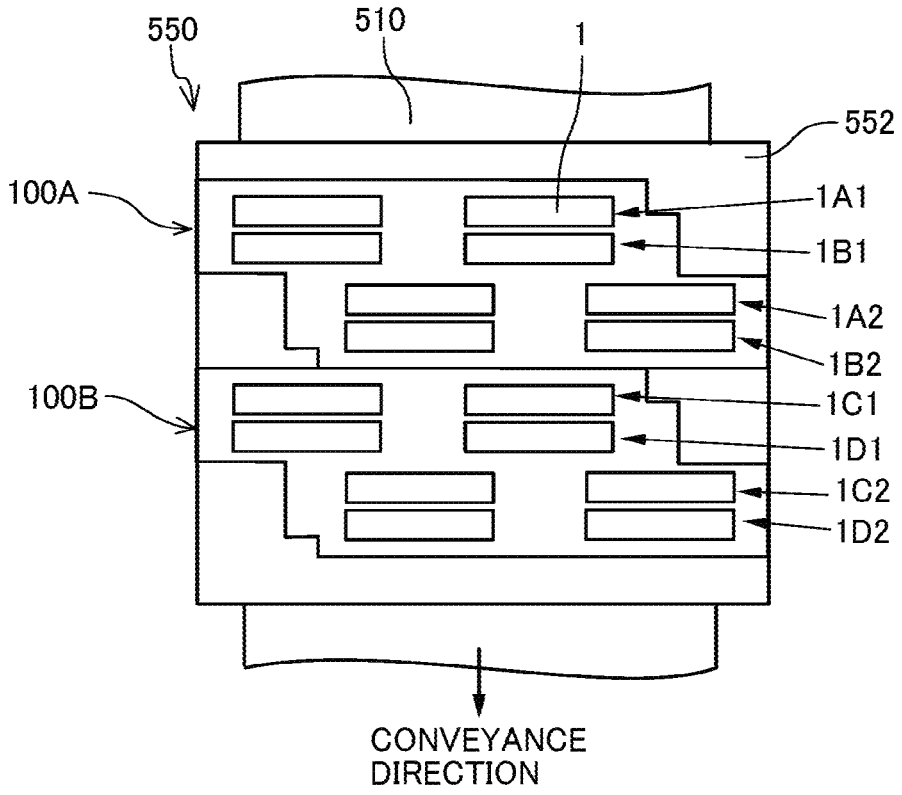
FIG. 20 is a plan view of an example of a head unit of the liquid discharge apparatus of FIG. 19.

FIGS. 19 and 20 illustrate an example of a liquid discharge apparatus according to an embodiment of the present disclosure. FIG. 19 is a side view of a liquid discharge apparatus according to an embodiment of the present disclosure. FIG. 20 is a plan view of a head unit of the liquid discharge apparatus of FIG. 19 according to the present embodiment.

A printer 500 serving as the liquid discharge apparatus includes a feeder 501 to feed a continuous medium 510, such as a rolled sheet, a guide conveyor 503 to guide and convey the continuous medium 510, fed from the feeder 501, to a printing unit 505, the printing unit 505 to discharge a liquid onto the continuous medium 510 to form an image on the continuous medium 510, a dryer 507 to dry the continuous medium 510, and an ejector 509 to eject the continuous medium 510.

The continuous medium 510 is fed from a winding roller 511 of the feeder 501, guided and conveyed with rollers of the feeder 501, the guide conveyor 503, the dryer 507, and the ejector 509, and wound around a take-up roller 591 of the ejector 509.

The continuous medium 510 is conveyed by the printing unit 505 to face the head unit 550, and an image is printed by the liquid discharged from the head unit 550.

Here, the head unit 550 includes two head modules 100A and 100B according to the present embodiment on a common base member 552.

The head module 100A includes head arrays 1A1, 1B1, 1A2, and 1B2. Each of the head arrays 1A1, 1B1, 1A2, and 1B2 includes a plurality of heads 1 arranged in a direction perpendicular to a conveyance direction of the continuous medium 510. The head module 100B includes head arrays 1C1, 1D1, 1C2, and 1D2. Each of the head arrays 1C1, 1D1, 1C2, and 1D2 includes a plurality of heads 1 arranged in the direction perpendicular to the conveyance direction. The head 1 in each of the head arrays 1A1 and 1A2 of the head module 100A discharges liquid of the same color. Similarly, the head arrays 1B1 and 1B2 of the head module 100A are grouped as one set that discharge liquid of the same color. The head arrays 1C1 and 1C2 of the head module 100B are grouped as one set that discharge liquid of the same color. The head arrays 1D1 and 1D2 are grouped as one set to discharge liquid of the same color.

Next, another example of a printer 500 serving as a liquid discharge apparatus according to the present embodiment is described with reference to FIGS. 19 and 20. FIG. 19 is a plan view of a portion of the printer 500. FIG. 20 is a side view of a portion of the printer 500 of FIG. 19.

The printer 500 is a serial type apparatus, and a carriage 403 is reciprocally moved in a main scanning direction by a main scan moving unit 493. The main scanning direction is indicated by arrow "MSD" in FIG. 21. The main scan moving unit 493 includes a guide 401, a main scanning motor 405, and a timing belt 408. The guide 401 is bridged between a left-side plate 491A and a right-side plate 491B, and movably holds the carriage 403. The main scanning motor 405 reciprocally moves the carriage 403 in the main scanning direction MSD via the timing belt 408 bridged between a driving pulley 406 and a driven pulley 407.

The carriage 403 mounts a liquid discharge device 440. The head 1 according to the present disclosure and a head tank 441 forms the liquid discharge device 440 as a single unit. The head 1 of the liquid discharge device 440 discharges liquid of each color, for example, yellow (Y), cyan (C), magenta (M), and black (K). The head 1 includes a nozzle array including a plurality of nozzles 11 arrayed in a sub-scanning direction SSD perpendicular to the main scanning direction MSD in FIG. 21. The head 1 is mounted to the carriage 403 so that ink droplets are discharged downward.

The printer 500 includes a conveyor 495 to convey a sheet 410. The conveyor 495 includes a conveyance belt 412 as a conveyor and a sub-scanning motor 416 to drive the conveyance belt 412.

The conveyance belt 412 attracts the sheet 410 and conveys the sheet 410 at a position facing the head 1. The conveyance belt 412 is an endless belt and is stretched between a conveyance roller 413 and a tension roller 414. Attraction of the sheet 410 to the conveyance belt 412 may be applied by electrostatic adsorption, air suction, or the like.

The conveyance belt 412 cyclically rotates in the sub-scanning direction SSD as the conveyance roller 413 is rotationally driven by the sub-scanning motor 416 via a timing belt 417 and a timing pulley 418.

At one side in the main scanning direction MSD of the carriage 403, a maintenance unit 420 to maintain the head 1 in good condition is disposed on a lateral side of the conveyance belt 412.

The maintenance unit 420 includes, for example, a cap 421 to cap the nozzle surface of the head 1 and a wiper 422 to wipe the nozzle surface of the head 1.

The main scan moving unit 493, the maintenance unit 420, and the conveyor 495 are mounted to a housing that includes a left-side plate 491A, a right-side plate 491B, and a rear-side plate 491C.

In the printer 500 thus configured, the sheet 410 is conveyed on and attracted to the conveyance belt 412 and is conveyed in the sub-scanning direction SSD by the cyclic rotation of the conveyance belt 412.

The head 1 is driven in response to image signals while the carriage 403 moves in the main scanning direction MSD, to discharge liquid to the sheet 410 stopped, thus forming an image on the sheet 410.

Figure 23:
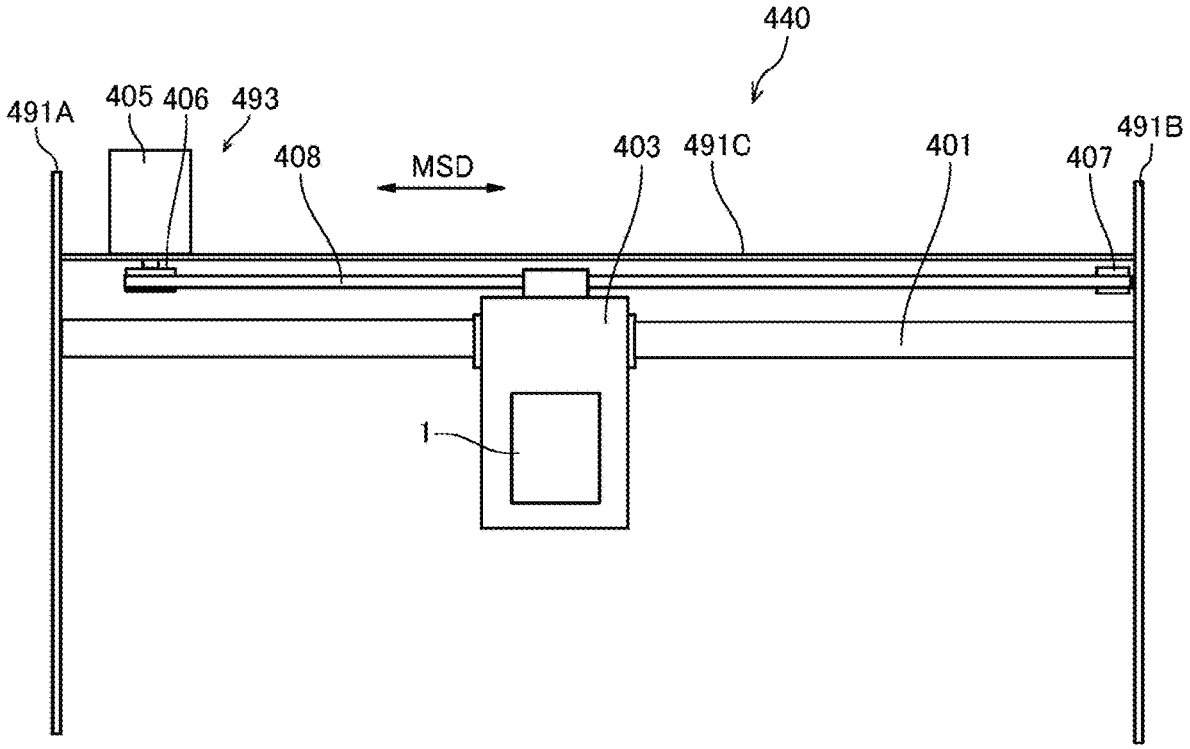
FIG. 23 is a plan view of a portion of another example of a liquid discharge device according to the present embodiment.
Figure 24:
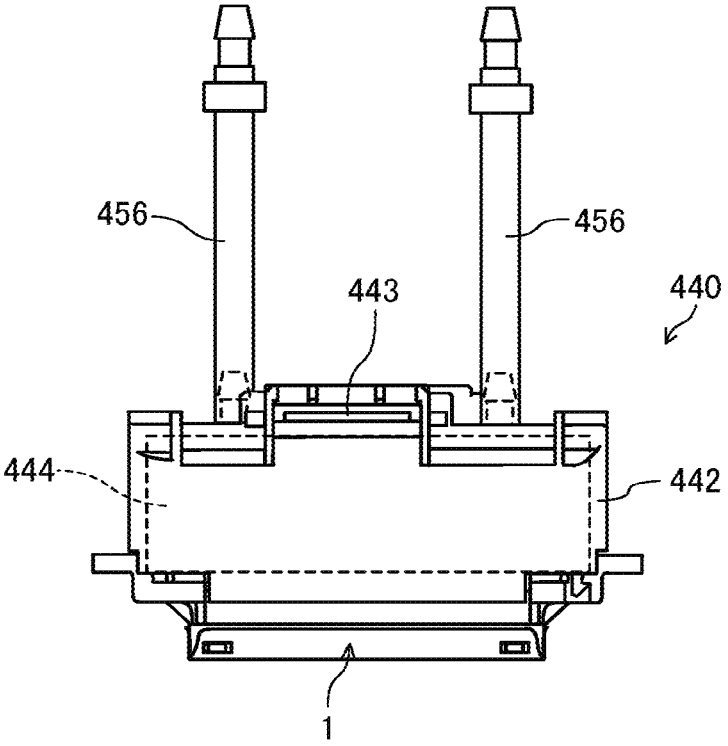
FIG. 24 is a front view of still another example of the liquid discharge device according to the embodiment of the present disclosure.

Next, the liquid discharge device 440 according to another embodiment of the present embodiment is described with reference to FIG. 23. FIG. 23 is a plan view of a portion of another example of the liquid discharge device 440.

Figure 21:
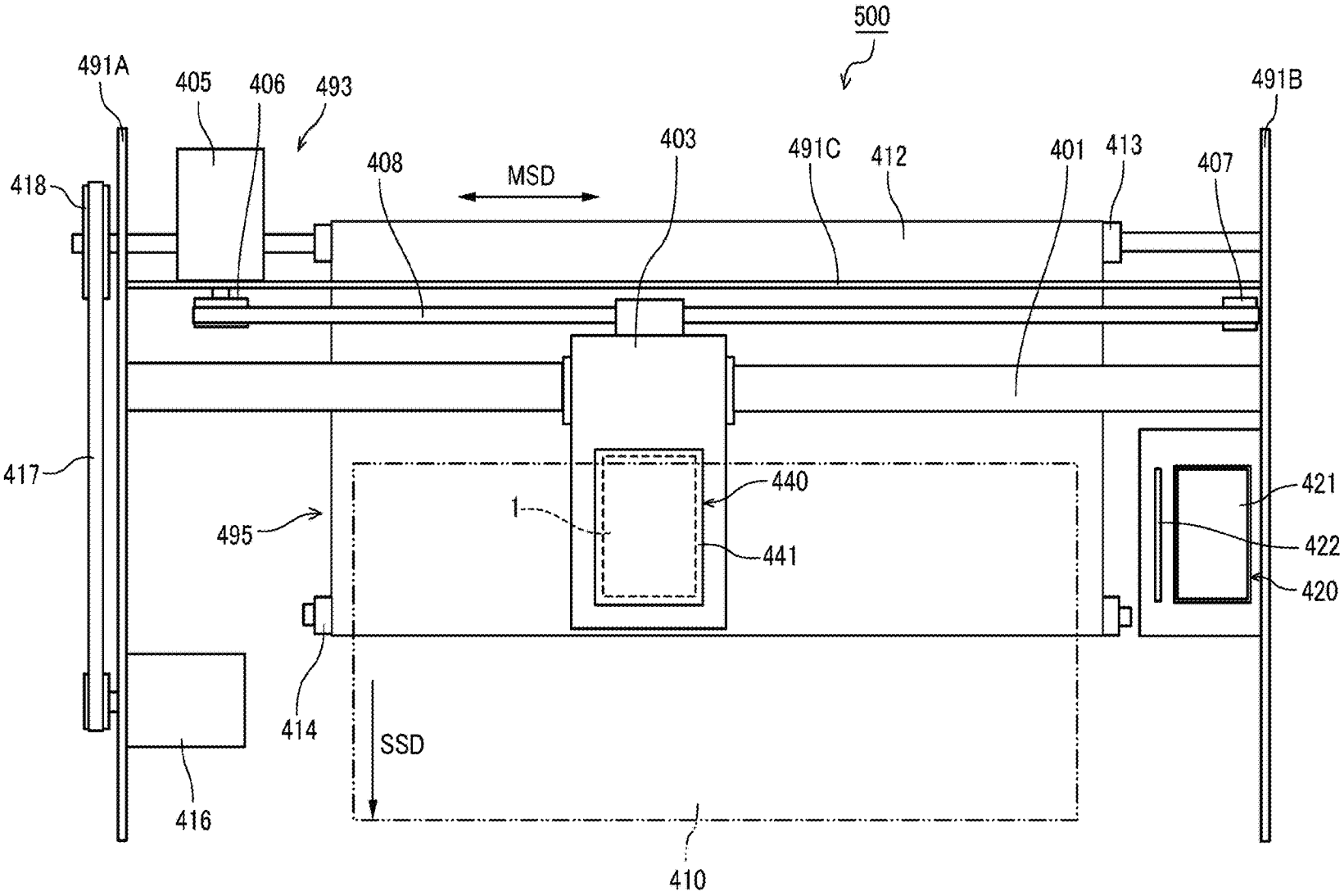
FIG. 21 is a plan view of a portion of a printer as a liquid discharge apparatus according to an embodiment of the present disclosure.

The liquid discharge device 440 includes a housing including a left-side plate 491A, a right-side plate 491B, and a rear-side plate 491C, the main scan moving unit 493, the carriage 403, and the head 1 among components of the printer 500 (liquid discharge apparatus) illustrated in FIG. 21.

Note that, in the liquid discharge device 440, the maintenance unit 420 described above may be mounted on, for example, the right-side plate 491B.

Figure 22:
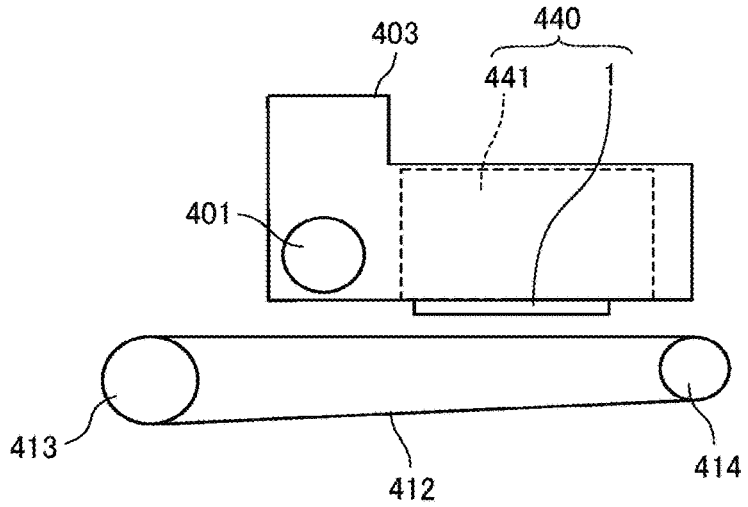
FIG. 22 is a schematic side view of a portion of the liquid discharge apparatus of FIG. 21.

Next, still another example of the liquid discharge device 440 according to the present embodiment is described with reference to FIG. 22. FIG. 22 is a front view of still another example of the liquid discharge device 440.

The liquid discharge device 440 includes the head 1, to which a channel part 444 is attached, and a tube 456 connected to the channel part 444.

Further, the channel part 444 is disposed inside a cover 442. Instead of the channel part 444, the liquid discharge device 440 may include the head tank 441. A connector 443 electrically connected with the head 1 is provided on an upper part of the channel part 444.

Further, "liquid" discharged from the head is not particularly limited as long as the liquid has a viscosity and surface tension of degrees dischargeable from the head. Preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of head tanks, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. A unit including a filter may be added at a position between the head tank and the head of the liquid discharge device.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms part of a maintenance unit may be secured to the carriage mounting the head so that the head, the carriage, and the maintenance unit form a single unit to form the liquid discharge device.

Further, in another example, the liquid discharge device includes tubes connected to the head to which the head tank or the channel member is attached so that the head and a supply unit form a single unit. Liquid is supplied from a liquid reservoir source to the head via the tube.

The main scan moving unit may be a guide only. The supply unit may be a tube(s) only or a loading unit only.

Here, the "liquid discharge device" may be a single unit in which the head and other functional parts are combined with each other. The "liquid discharge device" includes a head module including the above-described head, and a head device in which the above-described functional components and mechanisms are combined to form a single unit.

The term "liquid discharge apparatus" used herein also represents an apparatus including the head, the liquid discharge device, the head module, and the head device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate. Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material on which liquid is adhered, unless particularly limited.

Examples of the "material onto which liquid can adhere" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head, comprising:

a first member in which a plurality of channels is arrayed in a longitudinal direction of the first member;

a second member bonded to the first member with adhesive; and three or more holes formed in a bonding region between the first member and the second member, wherein an inner volume of each of the three or more holes is different, an area of each of the three or more holes is different, the three or more holes include a hole having a smallest inner volume among the three or more holes, the hole is filled with the adhesive in the bonding region, the three or more holes include another hole having an inner volume larger than the smallest inner volume of the hole among the three or more holes, and the another hole is partially filled with the adhesive in the bonding region.

2. The liquid discharge head according to claim 1, wherein the three or more holes are between an edge of the first member and an array of the plurality of channels in a width direction perpendicular to the longitudinal direction of the first member.

3. The liquid discharge head according to claim 1, wherein the three or more holes are in a center and both ends of the first member in the longitudinal direction of the first member.

4. The liquid discharge head according to claim 1, wherein the three or more holes are arrayed at a predetermined interval in the longitudinal direction of the first member.

5. The liquid discharge head according to claim 1, wherein the three or more holes are arrayed in parallel at a predetermined interval in the longitudinal direction of the first member.

6. The liquid discharge head according to claim 1, wherein areas of the three or more holes gradually increase.

7. A head module comprising an array of a plurality of liquid discharge heads including the liquid discharge head according to claim 1.

8. A head device comprising an array of a plurality of head modules including the head module according to claim 7.

9. A liquid discharge device comprising the head device according to claim 8.

10. A liquid discharge apparatus comprising the liquid discharge device according to claim 9.

11. A liquid discharge head, comprising:

a first member in which a plurality of channels is arrayed in a longitudinal direction of the first member;

a second member bonded to the first member with adhesive; and six or more holes formed in a bonding region between the first member and the second member, wherein an inner volume of each of the six or more holes is different, an area of each of the six or more holes is different, the six or more holes include a hole having a smallest inner volume among the six or more holes, the hole is filled with the adhesive in the bonding region, six holes of the six or more holes are arrayed side by side in an array direction, and areas of the six holes gradually increase or increase stepwise from a center hole in a center toward holes at both ends in the array direction.

12. A liquid discharge head, comprising:

a channel plate in which a plurality of channels is arrayed in a longitudinal direction of the channel plate;

a nozzle plate bonded to the channel plate with adhesive; and three or more holes formed in a bonding region between the nozzle plate and the channel plate, wherein an inner volume of each of the three or more holes is different, an area of each of the three or more holes is different, the three or more holes include a hole having a smallest inner volume among the three or more holes, the hole is filled with the adhesive in the bonding region, the three or more holes include another hole having an inner volume larger than the smallest inner volume of the hole among the three or more holes, and the another hole is partially filled with the adhesive in the bonding region.

13. The liquid discharge head according to claim 12, wherein the three or more holes are between an edge of the channel plate and an array of the plurality of channels in a width direction perpendicular to the longitudinal direction of the channel plate.

14. The liquid discharge head according to claim 12, wherein the three or more holes are in a center and both ends of the channel plate in the longitudinal direction of the first member.

15. The liquid discharge head according to claim 12, wherein the three or more holes are arrayed at a predetermined interval in the longitudinal direction of the channel plate.

16. The liquid discharge head according to claim 12, wherein the three or more holes are arrayed in parallel at a predetermined interval in the longitudinal direction of the channel plate.

17. The liquid discharge head according to claim 12, wherein areas of the three or more holes gradually increase.

* * * * *